US010621932B1

(12) United States Patent
Su et al.

(10) Patent No.: US 10,621,932 B1
(45) Date of Patent: Apr. 14, 2020

(54) SUB-PIXEL RENDERING DATA CONVERSION APPARATUS AND METHOD

(71) Applicant: Novatek Microelectronics Corp., Hsinchu (TW)

(72) Inventors: Shang-Yu Su, New Taipei (TW); Cheng-Wen Lin, Miaoli County (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/158,325

(22) Filed: Oct. 12, 2018

(51) Int. Cl.

| | |
|---|---|
| ***G09G 3/36*** | (2006.01) |
| ***G09G 5/391*** | (2006.01) |
| ***G09G 5/02*** | (2006.01) |
| ***G09G 3/20*** | (2006.01) |
| ***G09G 3/3208*** | (2016.01) |

(52) U.S. Cl.
CPC ..... *G09G 3/3607* (2013.01); *G09G 3/2074* (2013.01); *G09G 3/3208* (2013.01); *G09G 3/3614* (2013.01); *G09G 5/02* (2013.01); *G09G 2300/0452* (2013.01); *G09G 2340/0457* (2013.01)

(58) Field of Classification Search
CPC ... G09G 2300/0452; G09G 2340/0457; G09G 3/3607; G09G 3/2074; G09G 3/3208; G09G 3/3614; G09G 5/02
See application file for complete search history.

(56) References Cited

U.S. PATENT DOCUMENTS

| | | | | |
|---|---|---|---|---|
| 9,626,894 | B2 | 4/2017 | Gu | |
| 2008/0186325 | A1* | 8/2008 | Higgins | G09G 3/2003 345/592 |
| 2014/0232735 | A1* | 8/2014 | Jeong | G09G 3/2059 345/589 |
| 2015/0117774 | A1* | 4/2015 | Yang | G06T 9/00 382/166 |
| 2015/0125086 | A1* | 5/2015 | Jeong | H04N 19/136 382/239 |
| 2018/0130395 | A1* | 5/2018 | Yang | G09G 3/2003 |

FOREIGN PATENT DOCUMENTS

| | | |
|---|---|---|
| CN | 105027191 | 11/2015 |

* cited by examiner

*Primary Examiner* — Hong Zhou
(74) *Attorney, Agent, or Firm* — JCIPRNET

(57) ABSTRACT

A sub-pixel rendering data conversion apparatus including an inverse sub-pixel rendering circuit and a sub-pixel rendering circuit is provided. The inverse sub-pixel rendering circuit receives the first sub-pixel rendering data converted from the first true image data and converting the first sub-pixel rendering data to the second true image data, and the first sub-pixel rendering data includes data of the first sub-pixel rendering arrangement. The sub-pixel rendering circuit converts the second true image data to the second sub-pixel rendering data and outputs the second sub-pixel rendering data to a display panel, the second sub-pixel rendering data includes data of the second sub-pixel rendering arrangement, and the display panel includes a plurality of sub-pixels arranged in the manner of the second sub-pixel rendering arrangement.

17 Claims, 16 Drawing Sheets

SUB-PIXEL RENDERING DATA CONVERSION APPARATUS AND METHOD

BACKGROUND

Technical Field

The disclosure relates to a sub-pixel rendering data conversion apparatus and method.

Description of Related Art

With blooming development in display technology, market demands for performance requirements of a display panel are advancements in high resolution, high brightness and low-power consumption. However, with improved resolution of the display panel, because an amount of sub-pixels on the display panel will also increase for displaying in high resolution, the manufacturing cost is also increased accordingly. In order to reduce the manufacturing cost of the display panel, a sub-pixel rendering method (SPR method) has been proposed. A display apparatus generally uses different arrangements and designs of the sub-pixels to formulate a proper algorithm so a resolution visible by human eye (i.e., a visual resolution) may be increased.

Besides, in comparison with a data quantity of pixel data not processed by the SPR method, the pixel data processed by the SPR method can provide a reduced data quantity, which is conducive to data transmission.

SUMMARY

The disclosure is directed to a sub-pixel rendering data conversion apparatus and method capable of converting a sub-pixel rendering data for a sub-pixel rendering arrangement to another sub-pixel rendering data for another sub-pixel rendering arrangement.

The sub-pixel rendering data conversion apparatus of the disclosure includes an inverse sub-pixel rendering circuit and a sub-pixel rendering circuit. The inverse sub-pixel rendering circuit receives the first sub-pixel rendering data converted from the first true image data and converts the first sub-pixel rendering data to the second true image data, and the first sub-pixel rendering data includes data of the first sub-pixel rendering arrangement. The sub-pixel rendering circuit converts the second true image data to the second sub-pixel rendering data and outputs the second sub-pixel rendering data to a display panel, the second sub-pixel rendering data includes data of the second sub-pixel rendering arrangement, and the display panel includes a plurality of sub-pixels arranged in the manner of the second sub-pixel rendering arrangement.

In one embodiment of the disclosure, the inverse sub-pixel rendering circuit and the sub-pixel rendering circuit are located in a driver chip.

In one embodiment of the disclosure, the sub-pixel rendering data conversion apparatus further includes a data processing circuit located in the driver chip, and the second true image data is further processed by the data processing circuit.

In one embodiment of the disclosure, the sub-pixel rendering circuit is located in a driver chip, and the inverse sub-pixel rendering circuit is located in a decoder chip.

In one embodiment of the disclosure, the sub-pixel rendering data conversion apparatus further includes a data processing circuit located in the driver chip, and the second true image data is further processed by the data processing circuit.

In one embodiment of the disclosure, the first sub-pixel rendering arrangement and the second sub-pixel rendering arrangement are different. A sub-pixel rendering data conversion method of the disclosure includes steps of receiving a first sub-pixel rendering data converted from a first true image data, wherein the first sub-pixel rendering data comprises data of a first sub-pixel rendering arrangement; converting the first sub-pixel rendering data to a second true image data by an inverse sub-pixel rendering circuit; converting the second true image data to a second sub-pixel rendering data by a sub-pixel rendering circuit, wherein the second sub-pixel rendering data comprises data of a second sub-pixel rendering arrangement; and outputting the second sub-pixel rendering data to a display panel, wherein the display panel comprises a plurality of sub-pixels arranged in the manner of the second sub-pixel rendering arrangement.

In one embodiment of the disclosure, the sub-pixel rendering data conversion method further includes a step of processing the second true image data by a data processing circuit located in the driver chip.

A sub-pixel rendering data conversion apparatus of the disclosure includes a sub-pixel rendering circuit. The sub-pixel rendering circuit is configured to receive the first sub-pixel rendering data converted from the first true image data and convert the first sub-pixel rendering data to the second true image data at the first time, wherein the first sub-pixel rendering data includes data of the first sub-pixel rendering arrangement. In addition, the sub-pixel rendering circuit is configured to convert the second true image data to the second sub-pixel rendering data and output the second sub-pixel rendering data to a display panel at the second time, the second sub-pixel rendering data includes data of the second sub-pixel rendering arrangement, and the display panel includes a plurality of sub-pixels arranged in the manner of the second sub-pixel rendering arrangement.

In one embodiment of the disclosure, a controller controls the sub-pixel rendering circuit to perform an inverse function at the first time and a forward function at the second time.

In one embodiment of the disclosure, the sub-pixel rendering circuit is located in a driver chip.

In one embodiment of the disclosure, the sub-pixel rendering circuit is located in a decoder chip.

Based on the above, the first sub-pixel rendering data including data of the first sub-pixel rendering arrangement is received and then is inverted to the true image data that is converted to the second sub-pixel rendering data including data of the second sub-pixel rendering arrangement. The first sub-pixel rendering arrangement and the second sub-pixel rendering arrangement are different. Therefore, the data of different sub-pixel rendering arrangements can be obtained and provided to display panels.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
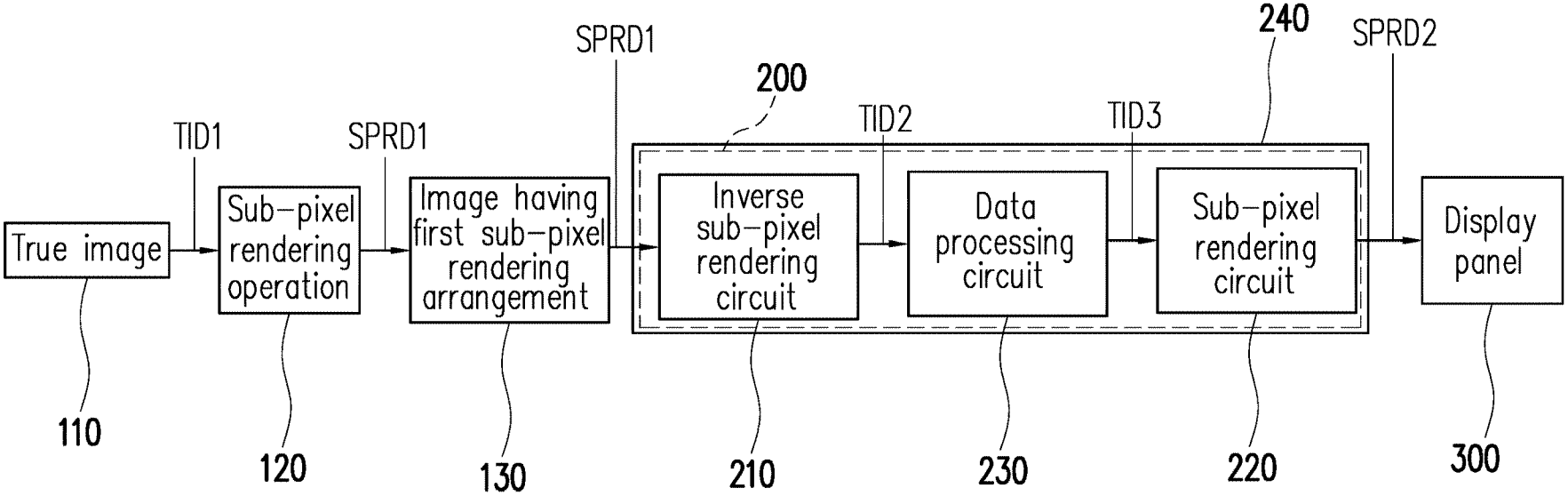
FIG. 1 is a schematic view illustrating data conversion process according to one embodiment of the disclosure.

FIG. 1 is a schematic view illustrating data conversion process according to one embodiment of the disclosure. As shown in FIG. 1, a true image 110 is an image produced by mixing the three primary colors: red, green, and blue from the three sub-pixels: red sub-pixel, green sub-pixel, and blue sub-pixel, respectively. The true image 110 includes the first true image data TID1 about the arrangement of the sub-pixels. The first true image data TID1 is provided to a sub-pixel rendering operation 120 and thus is converted to the first sub-pixel rendering data SPRD1. Herein, the first sub-pixel rendering data SPRD1 includes data of the first sub-pixel rendering arrangement and is provided for an image having the first sub-pixel rendering arrangement 130 (or the image after sub-pixel rendering operation).

Further, as shown in FIG. 1, a sub-pixel rendering data conversion apparatus 200 includes an inverse sub-pixel rendering circuit 210, a sub-pixel rendering circuit 220, and a data processing circuit 230. The inverse sub-pixel rendering circuit 210, the sub-pixel rendering circuit 220, and the data processing circuit 230 are located in a driver chip 240. The inverse sub-pixel rendering circuit 210 receives the first sub-pixel rendering data SPRD1 converted from the first true image data TID1 and converting the first sub-pixel rendering data SPRD1 to a second true image data TID2. Once again, the first sub-pixel rendering data SPRD1 includes data of the first sub-pixel rendering arrangement. Next, the second true image data TID2 is provided to the data processing circuit 230 and thus is further processed by the data processing circuit 230. To be more specific, the data processing circuit 230 converts the second true image data TID2 to a third true image data TID3. That is to say, the data processing circuit 230 is located in the driver chip 240, and the second true image data TID2 is further processed by the data processing circuit 230.

The third true image data TID3 is provided to the sub-pixel rendering circuit 220, and the sub-pixel rendering circuit 220 converts the third true image data TID3 to a second sub-pixel rendering data SPRD2 and outputs the second sub-pixel rendering data SPRD2 to a display panel 300. The second sub-pixel rendering data SPRD2 includes data of the second sub-pixel rendering arrangement, and the display panel 300 includes a plurality of sub-pixels arranged in the manner of the second sub-pixel rendering arrangement.

It is should be noted here, the first sub-pixel rendering arrangement and the second sub-pixel rendering arrangement are different from each other. However, the invention is not limited thereto. In other embodiments, the first sub-pixel rendering data is converted to the second true image data by the inverse sub-pixel rendering circuit of driver chip to provide for the data process. After be processed, the second true image data is converted back to the first sub-pixel rendering data. In other embodiments, the driver chip only includes an inverse sub-pixel rendering circuit, and the first sub-pixel rendering data is converted to the second true image data by the inverse sub-pixel rendering circuit to provide to a true image display panel.

Figure 2B:
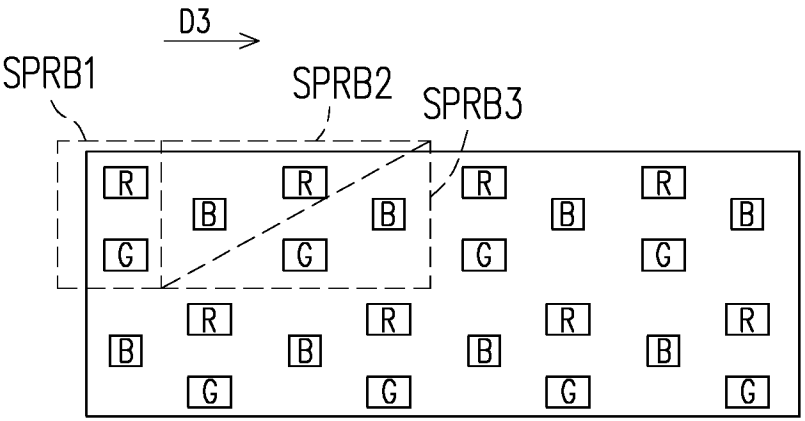
FIG. 2B is a schematic diagram illustrating another sub-pixel rendering arrangement according to one embodiment of the disclosure.
Figure 2A:
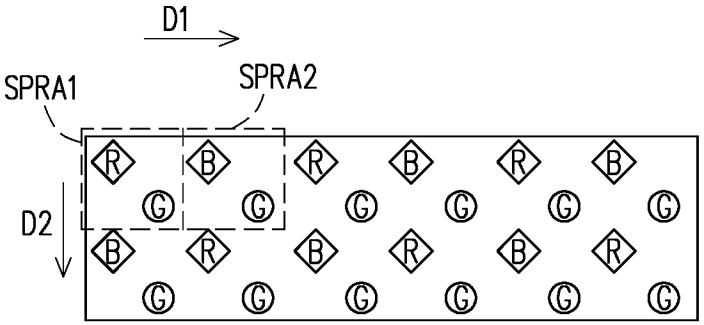
FIG. 2A is a schematic diagram illustrating a sub-pixel rendering arrangement according to one embodiment of the disclosure.

FIG. 2A is schematic diagram illustrating a sub-pixel rendering arrangement according to one embodiment of the disclosure. As shown in FIG. 2A, a sub-pixel rendering arrangement SPRA shows the arrangement of sub-pixels of a sub-pixel rendering (SPR) display panel. The SPR display panel may be an organic light-emitting diode (OLED) display panel or a light-emitting diode (LED) display panel, but the disclosure is not limited thereto. The data of the sub-pixel rendering arrangement SPRA is provided by a sub-pixel rendering process/operation. In the sub-pixel rendering arrangement SPRA, there are two types of pixels. The first type pixel SPRA1 includes two sub-pixels: one red sub-pixel R and one green sub-pixel G. The second type pixel SPRA2 includes two sub-pixels: one blue sub-pixel B and one green sub-pixel G. Further, the first type pixels SPRA1 and the second type pixels SPRA2 are arranged one after another in the first direction D1 and the second direction D2. The first direction D1 and the second direction D2 are perpendicular to each other.

FIG. 2B is schematic diagram illustrating another sub-pixel rendering arrangement according to one embodiment of the disclosure. As shown in FIG. 2B, a sub-pixel rendering arrangement SPRB shows the arrangement of sub-pixels of another SPR display panel. The data of the sub-pixel rendering arrangement SPRB is provided by a sub-pixel rendering process/operation. In the sub-pixel rendering arrangement SPRB, there are three types of pixels. The first type pixel SPRB1 includes two sub-pixels: one red sub-pixel R and one green sub-pixel G. The second type pixel SPRB2 includes two sub-pixels: one blue sub-pixel B and one red sub-pixel R. The third type pixel SPRB3 includes two sub-pixels: one green sub-pixel G and one blue sub-pixel B. Further, the first type pixels SPRB1, the second type pixels SPRB2, and the third type pixels SPRB3 are sequentially arranged one after another in the third direction D3 in the first row. In the second row, the first type pixels SPRB1, the second type pixels SPRB2, and the third type pixels SPRB3 are also sequentially arranged one after another in the third direction D3. However, in the two adjacent rows, the first type pixels SPRB1, the second type pixels SPRB2, and the third type pixels SPRB3 are not disposed corresponding to the first type pixels SPRB1, the second type pixels SPRB2, and the third type pixels SPRB3, respectively, in the column direction. In other words, in the two adjacent rows, the first type pixels SPRB1, the second type pixels SPRB2, and the third type pixels SPRB3 are misaligned with the first type pixels SPRB1, the second type pixels SPRB2, and the third type pixels SPRB3, respectively, in the column direction. Particularly, in column direction of the sub-pixel rendering arrangement SPRB in FIG. 2B, the first type pixels SPRB1 of the first row are aligned with the second type pixels SPRB2 of the second row instead of the first type pixels SPRB1 of the second row, the second type pixels SPRB2 of the first row are aligned with the third type pixels SPRB3 of the second row instead of the second type pixels SPRB2 of the second row, and the third type pixels SPRB3 of the first row are aligned with the first type pixels SPRB1 of the second row instead of the third type pixels SPRB3 of the second row. As a result, there is enough space provided for source lines in the display panel, in order to set correct sub-pixel color for each sub-pixel.

The first sub-pixel rendering arrangement may be one of the sub-pixel rendering arrangement SPRA and the sub-pixel rendering arrangement SPRB, and the second sub-pixel rendering arrangement may be the other one of the sub-pixel rendering arrangement SPRA and the sub-pixel rendering arrangement SPRB, the disclosure is not limited thereto. For example, if the first sub-pixel rendering arrangement is the sub-pixel rendering arrangement SPRA, the second sub-pixel rendering arrangement will be the sub-pixel rendering arrangement SPRB. If the first sub-pixel rendering arrangement is the sub-pixel rendering arrangement SPRB, the second sub-pixel rendering arrangement will be the sub-pixel rendering arrangement SPRA.

Figure 3:
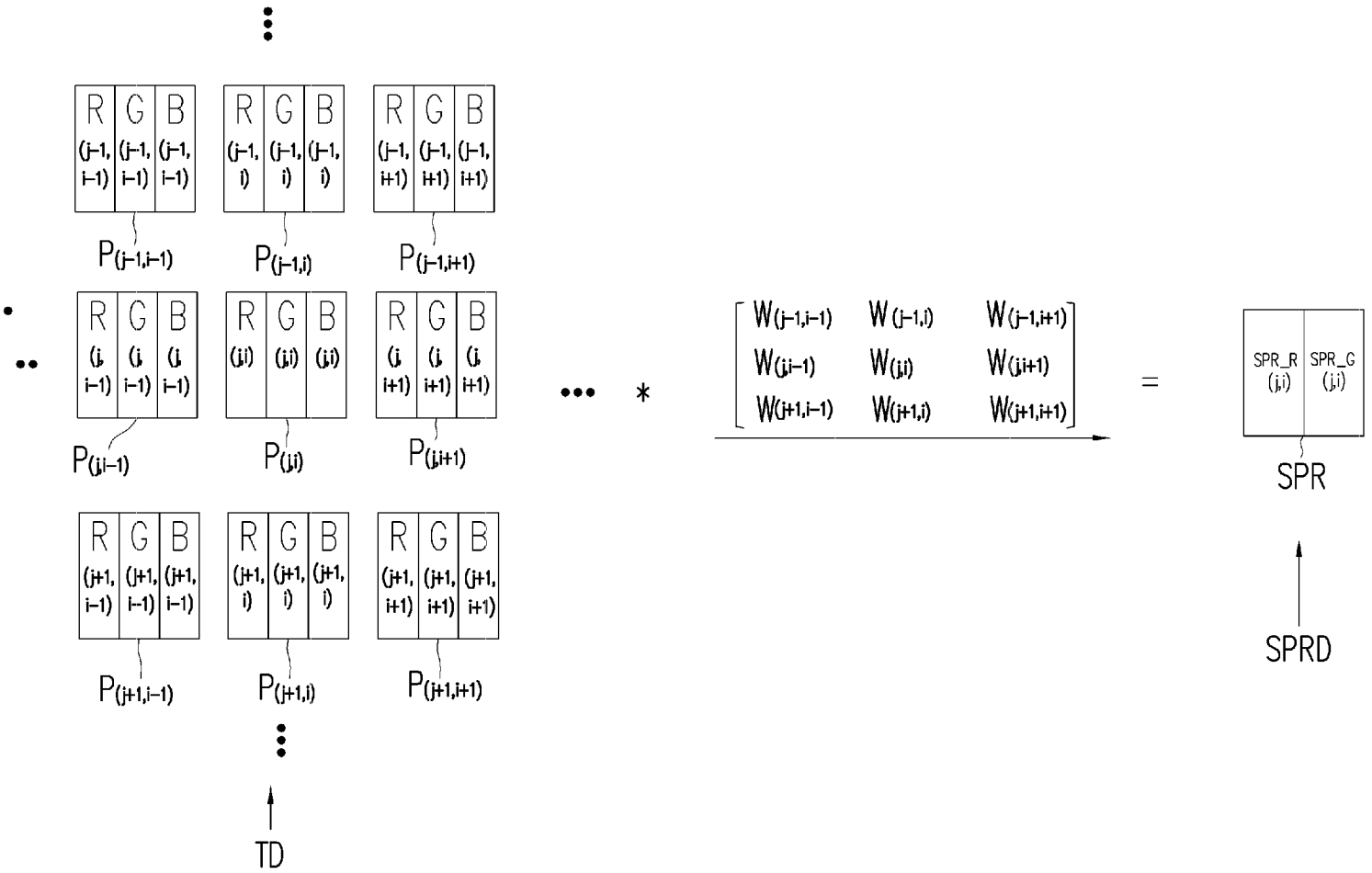
FIG. 3 is a schematic diagram illustrating a sub-pixel rendering operation according to one embodiment of the disclosure.

FIG. 3 is a schematic diagram illustrating a sub-pixel rendering operation according to one embodiment of the disclosure. In FIG. 3, 9 pixels of a true image display panel TD are shown as an example. Each of the pixels includes three sub-pixels: red sub-pixel, green sub-pixel, and blue sub-pixel. In addition, a pixel data includes a red sub-pixel data, a green sub-pixel data, and a blue sub-pixel data that are provided to the red sub-pixel, the green sub-pixel, and the blue sub-pixel, respectively. For example, a pixel data $P_{(j,i)}$ of a pixel at the $j^{th}$ row and the column includes a red sub-pixel data $R_{(j,i)}$, a green sub-pixel data $G_{(j,i)}$, and a blue sub-pixel data $B_{(j,i)}$. In addition, one pixel of a sub-pixel rendering (SPR) display panel SPRD is shown, the pixel includes a red sub-pixel and a green sub-pixel, as an example, the disclosure is not limited thereto. For example, one pixel of the SPR display panel SPRD may include two sub-pixels: the red sub-pixel and the blue sub-pixel or two sub-pixels: the blue sub-pixel and the green sub-pixel. A sub-pixel rendering data includes any two of a red sub-pixel rendering data, a green sub-pixel rendering data, and a blue sub-pixel rendering data and are provided to the pixel of the SPR display panel SPRD. As shown in FIG. 3, a sub-pixel rendering data $SPR_{(j,i)}$ of a pixel at the $j^{th}$ row and the column includes a red sub-pixel rendering data $SPR_R_{(j,i)}$ and a green sub-pixel rendering data $SPR_G_{(j,i)}$ that are respectively provided to the red sub-pixel and the green sub-pixel of the pixel.

In the sub-pixel rendering process/operation, the sub-pixel rendering data $SPR_{(j,i)}$ is obtained according to a set of color diffusion ratios $$\begin{bmatrix} W_{(j-1,i-1)} & W_{(j-1,i)} & W_{(j-1,i+1)} \\ W_{(j,i-1)} & W_{(j,i)} & W_{(j,i+1)} \\ W_{(j+1,i-1)} & W_{(j+1,i)} & W_{(j+1,i+1)} \end{bmatrix}$$

and the pixel data $P_{(j,i)}$ of pixel at the $j^{th}$ row and the $i^{th}$ column and the 8 pixel data $P_{(j-1,i-1)}$, $P_{(j-1,i)}$, $P_{(j-1,i+1)}$, $P_{(j,i-1)}$, $P_{(j,i+1)}$, $P_{(j+1,i-1)}$, $P_{(j+1,i)}$, $P_{(j+1,i+1)}$ of 8 pixels surrounding the pixel at the $j^{th}$ row and the $i^{th}$ column of the true image display panel TD. Herein, $W_{(j-1,i-1)}$, $W_{(j-1,i)}$, $W_{(j-1,i+1)}$, $W_{(j,i-1)}$, $W_{(j,i)}$, $W_{(j,i+1)}$, $W_{(j+1,i-1)}$, $W_{(j+1,i)}$, $W_{(j+1,i+1)}$ denote weights corresponding to pixel data $P_{(j-1,i-1)}$, $P_{(j-1,i)}$, $P_{(j-1,i+1)}$, $P_{(j,i-1)}$, $P_{(j,i)}$, $P_{(j,i+1)}$, $P_{(j+1,i-1)}$, $P_{(j+1,i)}$, $P_{(j+1,i+1)}$, respectively, of the true image display panel TD. In addition, Wr, Wb, and Wg denote weights corresponding to red sub-pixel, blue sub-pixel, and green sub-pixel, respectively.

For example, the red sub-pixel rendering data $SPR_R_{(j,i)}$, the blue sub-pixel rendering data $SPR\ B_{(j,i)}$, the green sub-pixel rendering data $SPR_G_{(j,i)}$ of the SPR display panel SPRD are calculated by the following equations:

$$\begin{aligned} SPR_R_{(j,i)} = {} & R_{(j-1,i-1)} \times Wr_{(j-1,i-1)} + R_{(j-1,i)} \times Wr_{(j-1,i)} + \\ & R_{(j-1,i+1)} \times Wr_{(j-1,i+1)} + R_{(j,i-1)} \times Wr_{(j,i-1)} + R_{(j,i)} \times \\ & Wr_{(j,i)} + R_{(j,i+1)} \times Wr_{(j,i+1)} + R_{(j+1,i-1)} \times Wr_{(j+1,i-1)} + \\ & R_{(j+1,i)} \times Wr_{(j+1,i)} + R_{(j+1,i+1)} \times Wr_{(j+1,i+1)}. \end{aligned}$$

$$\begin{aligned} SPR_B_{(j,i)} = {} & B_{(j-1,i-1)} \times Wb_{(j-1,i-1)} + B_{(j-1,i)} \times Wb_{(j-1,i)} + \\ & B_{(j-1,i+1)} \times Wb_{(j-1,i+1)} + B_{(j,i-1)} \times Wb_{(j,i-1)} + B_{(j,i)} \times \\ & Wb_{(j,i)} + B_{(j,i+1)} \times Wb_{(j,i+1)} + B_{(j+,i-1)} \times Wb_{(j+1,i-1)} + \\ & B_{(j+1,i)} \times Wb_{(j+1,i)} + B_{(j+1,i+1)} \times Wb_{(j+1,i+1)}. \end{aligned}$$

$$\begin{aligned} SPR_G_{(j,i)} = {} & G_{(j-1,i-1)} \times Wg_{(j-1,i-1)} + G_{(j-1,i)} \times Wg_{(j-1,i)} + \\ & G_{(j-1,i+1)} \times Wg_{(j-1,i+1)} + G_{(j,i-1)} \times Wg_{(j,i-1)} + G_{(j,i)} \times \\ & Wg_{(j,i)} + G_{(j,i+1)} \times Wg_{(j,i+1)} + G_{(j+,i-1)} \times Wg_{(j+1,i-1)} + \\ & G_{(j+1,i)} \times Wg_{(j+1,i)} + G_{(j+1,i+1)} \times Wg_{(j+1,i+1)}. \end{aligned}$$

Figure 4:
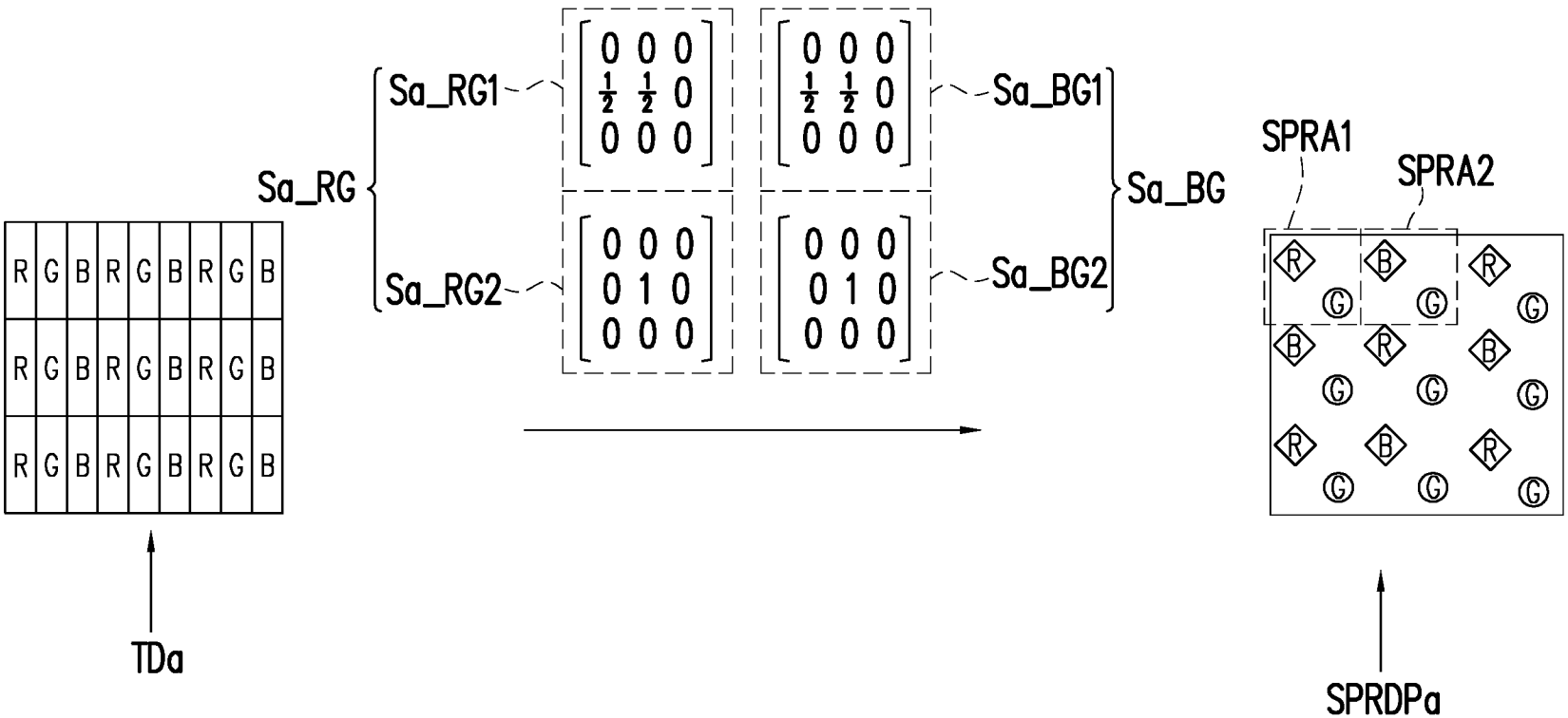
FIG. 4 is a schematic diagram illustrating an example of the sub-pixel rendering operation.

FIG. 4 is a schematic diagram illustrating an example of the sub-pixel rendering operation. As shown in FIG. 4, a SPR display panel SPRDPa has the sub-pixel rendering arrangement SPRA shown in FIG. 2A. Data of the first type pixel SPRA1 of the SPR display panel SPRDPa is obtained according to a set of color diffusion ratios Sa_RG having two sub-sets Sa_RG1 and Sa_RG2 and the pixel data of a true image display panel TDa. The sub-set Sa_RG1 is $$\begin{bmatrix} 0 & 0 & 0 \\ \frac{1}{2} & \frac{1}{2} & 0 \\ 0 & 0 & 0 \end{bmatrix},$$

and the sub-set Sa_RG2 is $$\begin{bmatrix} 0 & 0 & 0 \\ 0 & 1 & 0 \\ 0 & 0 & 0 \end{bmatrix}.$$

To be more specific, in addition to the pixel data of the true image display panel TDa, data of the red sub-pixel R in the first type pixel SPRA1 is obtained according to the sub-set Sa_RG1, and data of the green sub-pixel G in the first type pixel SPRA1 is obtained according to the sub-set Sa_RG2. Similarly, data of the second type pixel SPRA2 of the SPR display panel SPRDa is obtained according to a set of color diffusion ratios Sa_BG having two sub-sets Sa_BG1 and Sa_BG2 and the pixel data of a true image display panel TDa. The sub-set Sa_BG1 is $$\begin{bmatrix} 0 & 0 & 0 \\ \frac{1}{2} & \frac{1}{2} & 0 \\ 0 & 0 & 0 \end{bmatrix},$$

and the sub-set Sa_BG2 is $$\begin{bmatrix} 0 & 0 & 0 \\ 0 & 1 & 0 \\ 0 & 0 & 0 \end{bmatrix}.$$

To be more specific, in addition to the pixel data of the true image display panel TDa, data of the blue sub-pixel B in the second type pixel SPRA2 is obtained according to the sub-set Sa_BG1, and data of the green sub-pixel G in the second type pixel SPRA2 is obtained according to the sub-set Sa_BG2.

Figure 5:
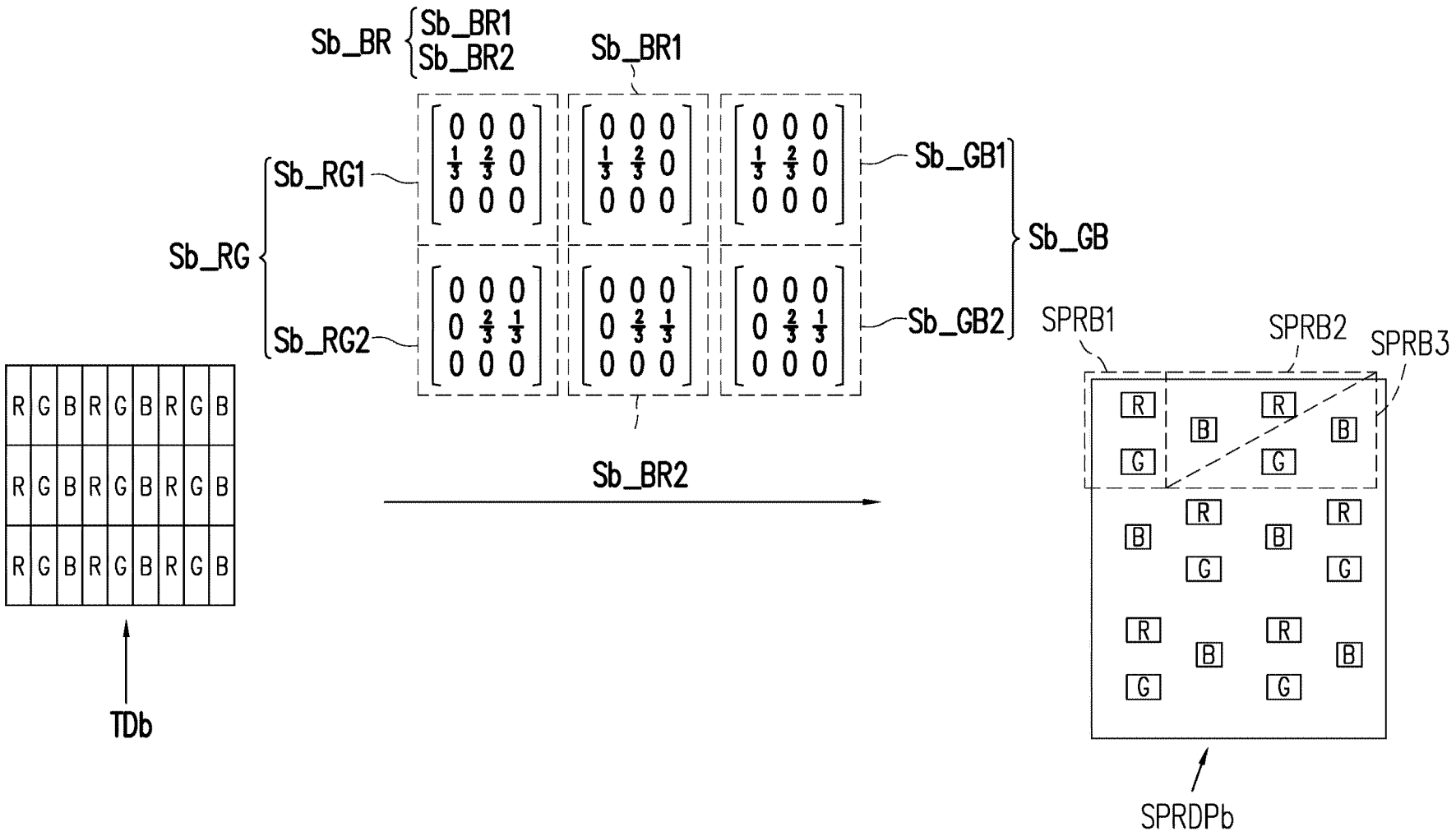
FIG. 5 is a schematic diagram illustrating another example of the sub-pixel rendering operation.

FIG. 5 is a schematic diagram illustrating another example of the sub-pixel rendering operation. As shown in FIG. 5, a SPR display panel SPRDb has the sub-pixel rendering arrangement SPRB shown in FIG. 2B. Data of the first type pixel SPRB1 of the SPR display panel SPRDPb is obtained according to a set of color diffusion ratios Sa_RG having two sub-sets Sb_RG1 and Sb_RG2 and the pixel data of a true image display panel TDb. The sub-set Sb_RG1 is $$\begin{bmatrix} 0 & 0 & 0 \\ \frac{1}{3} & \frac{2}{3} & 0 \\ 0 & 0 & 0 \end{bmatrix},$$

the sub-set Sb_RG2 is $$\begin{bmatrix} 0 & 0 & 0 \\ 0 & \frac{2}{3} & \frac{1}{3} \\ 0 & 0 & 0 \end{bmatrix}.$$

To be more specific, in addition to the pixel data of the true image display panel TDb, data of the red sub-pixel R in the first type pixel SPRB1 is obtained according to the sub-set Sb_RG1, and data of the green sub-pixel G in the first type pixel SPRB1 is obtained according to the sub-set Sb_RG2. Similarly, data of the second type pixel SPRB2 of the SPR display panel SPRDPb is obtained according to a set of color diffusion ratios Sb_BR having two sub-sets Sb_BR1 and Sb_BR2 and the pixel data of the true image display panel TDb. The sub-set Sb_BR1 is $$\begin{bmatrix} 0 & 0 & 0 \\ \frac{1}{3} & \frac{2}{3} & 0 \\ 0 & 0 & 0 \end{bmatrix},$$

and the sub-set Sb_BR2 is $$\begin{bmatrix} 0 & 0 & 0 \\ 0 & \frac{2}{3} & \frac{1}{3} \\ 0 & 0 & 0 \end{bmatrix}.$$

To be more specific, in addition to the pixel data of the true image display panel TDb, data of the blue sub-pixel B in the second type pixel SPRB2 is obtained according to the sub-set Sb_BR1, and data of the red sub-pixel R in the second type pixel SPRB2 is obtained according to the sub-set Sb_BR2. Further, data of the third type pixel SPRB3 of the SPR display panel SPRDPb is obtained according to a set of color diffusion ratios Sb_GB having two sub-sets Sb_GB1 and Sb_GB2 and the pixel data of the true image display panel TDb. The sub-set Sb_GB1 is $$\begin{bmatrix} 0 & 0 & 0 \\ \frac{1}{3} & \frac{2}{3} & 0 \\ 0 & 0 & 0 \end{bmatrix},$$

and the sub-set Sb_GB2 is $$\begin{bmatrix} 0 & 0 & 0 \\ 0 & \frac{2}{3} & \frac{1}{3} \\ 0 & 0 & 0 \end{bmatrix}.$$

To be more specific, in addition to the pixel data of the true image display panel TDb, data of the green sub-pixel G in the third type pixel SPRB3 is obtained according to the sub-set Sb_GB1, and data of the blue sub-pixel B in the third type pixel SPRB3 is obtained according to the sub-set Sb_GB2.

Figure 6:
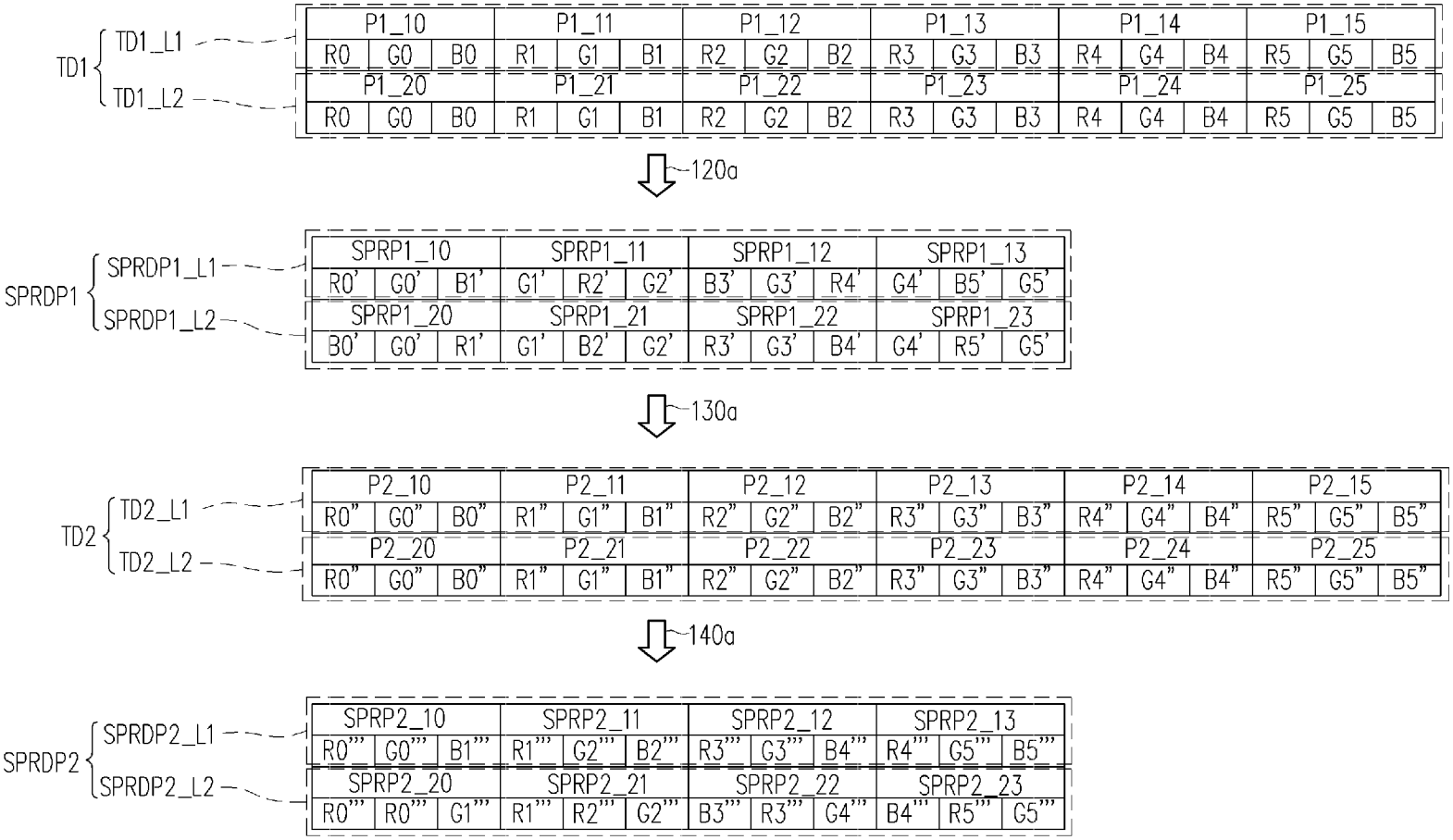
FIG. 6 is a schematic diagram illustrating data conversion process according to one embodiment of the disclosure.

FIG. 6 is a schematic diagram illustrating data conversion process according to one embodiment of the disclosure. A true image display panel TD1 has display resolution of 1920×1080, and each pixel has three sub-pixels. However, two lines TD1_L1 and TD1_L2 with six pixels in each line are shown in FIG. 6. The six pixels in the line TD1_L1 include a pixel data P1_10, a pixel data P1_11, a pixel data P1_12, a pixel data P1_13, a pixel data P1_14, and a pixel data P1_15. The six pixels in the line TD1_L2 include a pixel data P1_20, a pixel data P121, a pixel data P1_22, a pixel data P123, a pixel data P124, and a pixel data P1_25. The pixel data P1_10 includes a red sub-pixel data R0, a green sub-pixel data G0, and blue sub-pixel data B0. The pixel data P1_11 includes a red sub-pixel data R1, a green sub-pixel data G1, and blue sub-pixel data B1. The pixel data P1_12 includes a red sub-pixel data R2, a green sub-pixel data G2, and blue sub-pixel data B2. The pixel data P1_13 includes a red sub-pixel data R3, a green sub-pixel data G3, and blue sub-pixel data B3. The pixel data P1_14 includes a red sub-pixel data R4, a green sub-pixel data G4, and blue sub-pixel data B4. The pixel data P1_15 includes a red sub-pixel data R5, a green sub-pixel data G5, and blue sub-pixel data B5. Similarly, the pixel data P1_20 includes a red sub-pixel data R0, a green sub-pixel data G0, and blue sub-pixel data B0. The pixel data P1_21 includes a red sub-pixel data R1, a green sub-pixel data G1, and blue sub-pixel data B1. The pixel data P1_22 includes a red sub-pixel data R2, a green sub-pixel data G2, and blue sub-pixel data B2. The pixel data P1_23 includes a red sub-pixel data R3, a green sub-pixel data G3, and blue sub-pixel data B3. The pixel data P1_24 includes a red sub-pixel data R4, a green sub-pixel data G4, and blue sub-pixel data B4. The pixel data P1_25 includes a red sub-pixel data R5, a green sub-pixel data G5, and blue sub-pixel data B5. The sub-pixel data represents data value, such as the luminance value, of a sub-pixel and includes data of sub-pixel arrangement of the true image display panel TD1.

In addition, a SPR display panel SPRDP1 has display resolution of 1920×720, and each pixel has three sub-pixels, and the SPR display panel SPRDP1 has the sub-pixel rendering arrangement SPRA. However, two lines SPRDP1_L1 and SPRDP1_L2 with four pixels in each line are shown in FIG. 6. The four pixels in the line SPRDP1_L1 include a pixel data SPRP1_10, a pixel data SPRP1_11, a pixel data SPRP1_12, a pixel data SPRP1_13. The four pixels in the line SPRDP1_L2 include a pixel data SPRP1_20, a pixel data SPRP1_21, a pixel data SPRP1_22, a pixel data SPRP1_23. The pixel data SPRP1_10 includes a red sub-pixel data R0', a green sub-pixel data G0', and a blue sub-pixel data B1'. The pixel data SPRP1_11 includes a green sub-pixel data G1', a red sub-pixel data R2', and a green sub-pixel data G2'. The pixel data SPRP1_12 includes a blue sub-pixel data B3', a green sub-pixel data G3', and a red sub-pixel data R4'. The pixel data SPRP1_13 includes a green sub-pixel data G4', a blue sub-pixel data B5', and a green sub-pixel data G5'. In addition, the pixel data SPRP1_20 includes a blue sub-pixel data B0', a green sub-pixel data G0', and a red sub-pixel data R1'. The pixel data SPRP1_21 includes a green sub-pixel data G1', a blue sub-pixel data B2', a green sub-pixel data G2'. The pixel data SPRP1_22 includes a red sub-pixel data R3', a green sub-pixel data G3', a blue sub-pixel data B4'. Further, the pixel data SPRP1_23 includes a green sub-pixel data G4', a red sub-pixel data R5', and a green sub-pixel data G5'. The sub-pixel data represents data value, such as the luminance value, of a sub-pixel and includes data of sub-pixel arrangement of the SPR display panel SPRDP1. The pixel data of the SPR display panel SPRDP1 (such as the pixel data SPRP1_10, SPRP1_1, SPRP1_12, SPRP1_13 of the line SPRDP1_L1 and the pixel data SPRP1_20, SPRP1_21, SPRP1_22, SPRP1_23 of the line SPRD1_L2) are calculated according to the pixel data of the true image display panel TD1 (such as the pixel data P1_10, the pixel data P1_11, the pixel data P1_12, the pixel data P1_13, the pixel data P1_14, and the pixel data P1_15 of the line TD1_L1 and the pixel data P1_20, the pixel data P1_21, the pixel data P1_22, the pixel data P1_23, the pixel data P1_24, and the pixel data P1_25 of the line TD1_L2) and is calculated through the first sub-pixel rendering operation 120*a*, which is similar to the sub-pixel rendering operation 120 shown in FIG. 1.

Next, data of a true image display panel TD2 is shown in FIG. 6. The true image display panel TD2 has display resolution of 1920×1080, and each pixel has three sub-pixels. However, two lines TD2_L1 and TD2_L2 with six pixels in each line are shown in FIG. 6. The data of the six pixels in the line TD2_L1 include a pixel data P2_10, a pixel data P2_11, a pixel data P2_12, a pixel data P2_13, a pixel data P2_14, and a pixel data P2_15. The data of the six pixels in the line TD2_L2 include a pixel data P2_20, a pixel data P2_21, a pixel data P2_22, a pixel data P2_23, a pixel data P2_24, and a pixel data P2_25. The pixel data P2_10 includes a red sub-pixel data R0", a green sub-pixel data G0", and blue sub-pixel data B0". The pixel data P2_11 includes a red sub-pixel data R1", a green sub-pixel data G1", and blue sub-pixel data B1". The pixel data P2_12 includes a red sub-pixel data R2", a green sub-pixel data G2", and blue sub-pixel data B2". The pixel data P2_13 includes a red sub-pixel data R3", a green sub-pixel data G3", and blue sub-pixel data B3". The pixel data P2_14 includes a red sub-pixel data R4", a green sub-pixel data G4", and blue sub-pixel data B4". The pixel data P2_15 includes a red sub-pixel data R5", a green sub-pixel data G5", and blue sub-pixel data B5". Similarly, the pixel data P2_20 includes a red sub-pixel data R0", a green sub-pixel data G0", and blue sub-pixel data B0". The pixel data P2_21 includes a red sub-pixel data R1", a green sub-pixel data G1", and blue sub-pixel data B1". The pixel data P2_22 includes a red sub-pixel data R2", a green sub-pixel data G2", and blue sub-pixel data B2". The pixel data P2_23 includes a red sub-pixel data R3", a green sub-pixel data G3", and blue sub-pixel data B3". The pixel data P2_24 includes a red sub-pixel data R4", a green sub-pixel data G4", and blue sub-pixel data B4". The pixel data P2_25 includes a red sub-pixel data R5", a green sub-pixel data G5", and blue sub-pixel data B5". The sub-pixel data represents data value, such as the luminance value, of a sub-pixel and includes data of sub-pixel arrangement of the true image display panel TD2. In addition, the pixel data of the true image display panel TD2 (such as the pixel data P2_10, P2_11, P2_12, P2_13, P2_14, P2_15, P2_20, P2_21, P2_22, P2_23, P2_24, and P2_25) is calculated by inverting the pixel data of the SPR display panel SPRDP1 (such as the pixel data SPRP1_10, SPRP1_11, SPRP1_12, SPRP1_13, SPRP1_20, SPRP1_21, SPRP1_22, and SPRP1_23) or is calculated through an inverting operation 130*a*.

Further, data of a SPR display panel SPRDP2 is shown in FIG. 6. The SPR display panel SPRDP2 has display resolution of 1920×720, and each pixel has three sub-pixels, and the SPR display panel SPRDP2 has the sub-pixel rendering arrangement SPRB. However, two lines SPRDP2_L1 and SPRDP2_L2 with four pixels in each line are shown in FIG. 6. The four pixels in the line SPRDP2_L1 include a pixel data SPRP2_10, a pixel data SPRP2_11, a pixel data SPRP2_12, a pixel data SPRP2_13. The four pixels in the line SPRD2_L2 include a pixel data SPRP2_20, a pixel data SPRP2_21, a pixel data SPRP2_22, a pixel data SPRP2_23. The pixel data SPRP2_10 includes a red sub-pixel data R0''', a green sub-pixel data G0''', and a blue sub-pixel data B1'''. The pixel data SPRP2_11 includes a red sub-pixel data R1''', a green sub-pixel data G2''', and a blue sub-pixel data B2'''. The pixel data SPRP2_12 includes a red sub-pixel data R3''', a green sub-pixel data G3''', and a blue sub-pixel data B4'''. The pixel data SPRP2_13 includes a red sub-pixel data R4''', a green sub-pixel data G5''', and a blue sub-pixel data B5'''. In addition, the pixel data SPRP2_20 includes a blue sub-pixel data B0''', a red sub-pixel data R0''', and a green sub-pixel data G1'''. The pixel data SPRP2_21 includes a blue sub-pixel data B1''', a red sub-pixel data R2''', and a green sub-pixel data G2'''. The pixel data SPRP2_22 includes a blue sub-pixel data B3''', a red sub-pixel data R3''', and a green sub-pixel data G4'''. The pixel data SPRP2_23 includes a blue sub-pixel data B4''', a red sub-pixel data R5''', and a green sub-pixel data G5'''. The data of the SPR display panel SPRDP2 (such as pixel data SPRP2_10, SPRP2_11, SPRP2_12, SPRP2_13, SPRP2_20, SPRP2_21, SPRP2_22, and SPRP2_23) is calculated according to the data of the true image display panel TD2 (such as the pixel data P2_10, P2_1, P2_12, P2_13, P2_14, P2_15, P2_20, P2_21, P2_22, P2_23, P2_24, and P2_25) and calculated through the second sub-pixel rendering operation 140*a* (such as the second sub-pixel rendering data SPRD2). The first sub-pixel rendering operation 120*a* and the inverting operation 130*a* are described hereinafter as an example.

Figure 7:
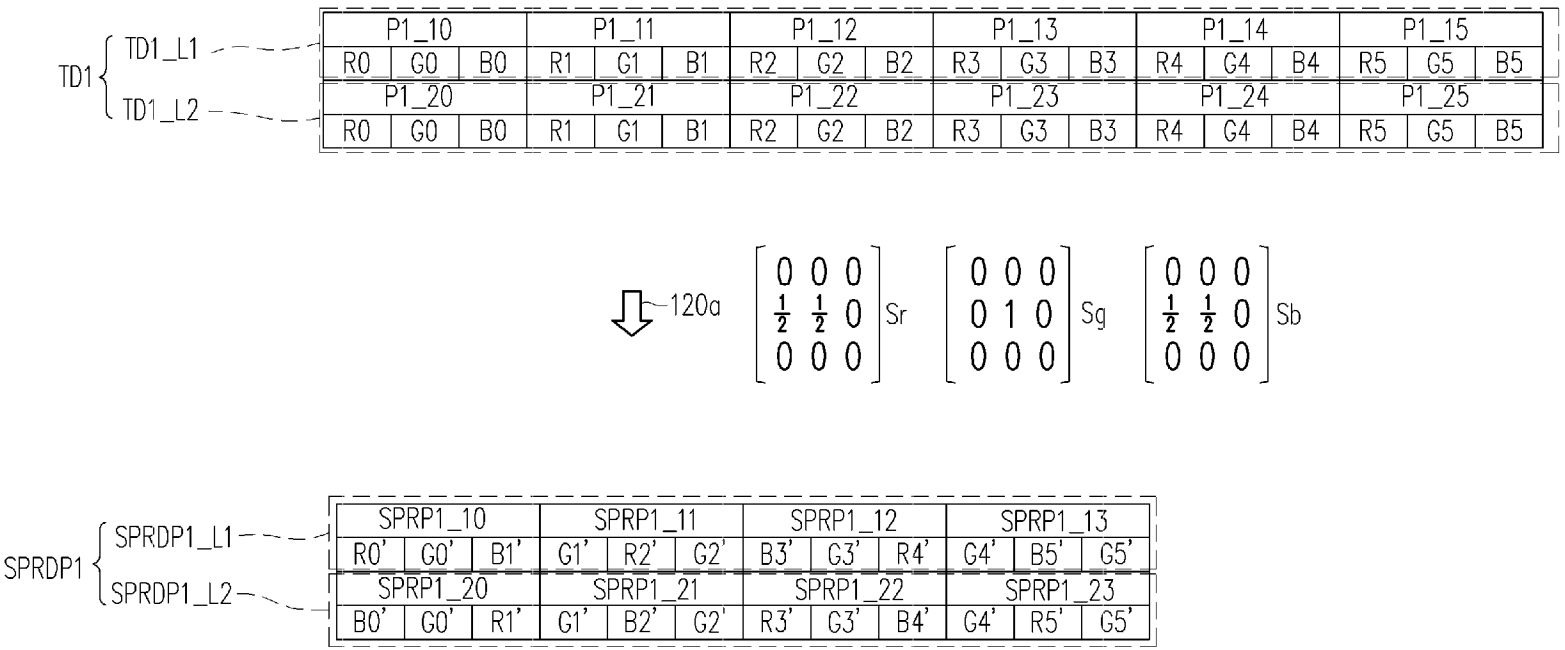
FIG. 7 is a schematic diagram illustrating the first sub-pixel rendering operation in FIG. 6.

FIG. 7 is a schematic diagram illustrating the first sub-pixel rendering operation in FIG. 6. As shown in FIG. 7, the sub-pixel rendering data of the SPR display panel SPRDP1 is obtained according to three set of color diffusion ratios and the pixel data of the true image display panel TD1. To be more specific, for red color, the set of color diffusion ratios Sr is $$\begin{bmatrix} 0 & 0 & 0 \\ \frac{1}{2} & \frac{1}{2} & 0 \\ 0 & 0 & 0 \end{bmatrix}.$$

For green color, the set of color diffusion ratios Sg is $$\begin{bmatrix} 0 & 0 & 0 \\ 0 & 1 & 0 \\ 0 & 0 & 0 \end{bmatrix}.$$

For blue color, the set of color diffusion ratios Sb is $$\begin{bmatrix} 0 & 0 & 0 \\ \frac{1}{2} & \frac{1}{2} & 0 \\ 0 & 0 & 0 \end{bmatrix}.$$

Therefore, the sub-pixel rendering data of the line SPRDP1_L1 is calculated as follows: R0'=(0+R0)/2, R2'=(R1+R2)/2, R4'=(R3+R4)/2, G0'=G0, G1'=G1, G2'=G2, G3'=G3, G4'=G4, G5'=G5, B1'=(B0+B1)/2, B3'=(B2+B3)/2, and B5'=(B4+B5)/2. Additionally, the sub-pixel rendering data of the line SPRDP1_L2 is calculates as follows: R1'=(R0+R1)/2, R3'=(R2+R3)/2, R5'=(R4+R5)/2, G0'=G0, G1'=G1, G2'=G2, G3'=G3, G4'=G4, G5'=G5, B0'=(0+B0)/2, B2'=(B1+B2)/2, and B4'=(B3+B4)/2.

Figure 8:
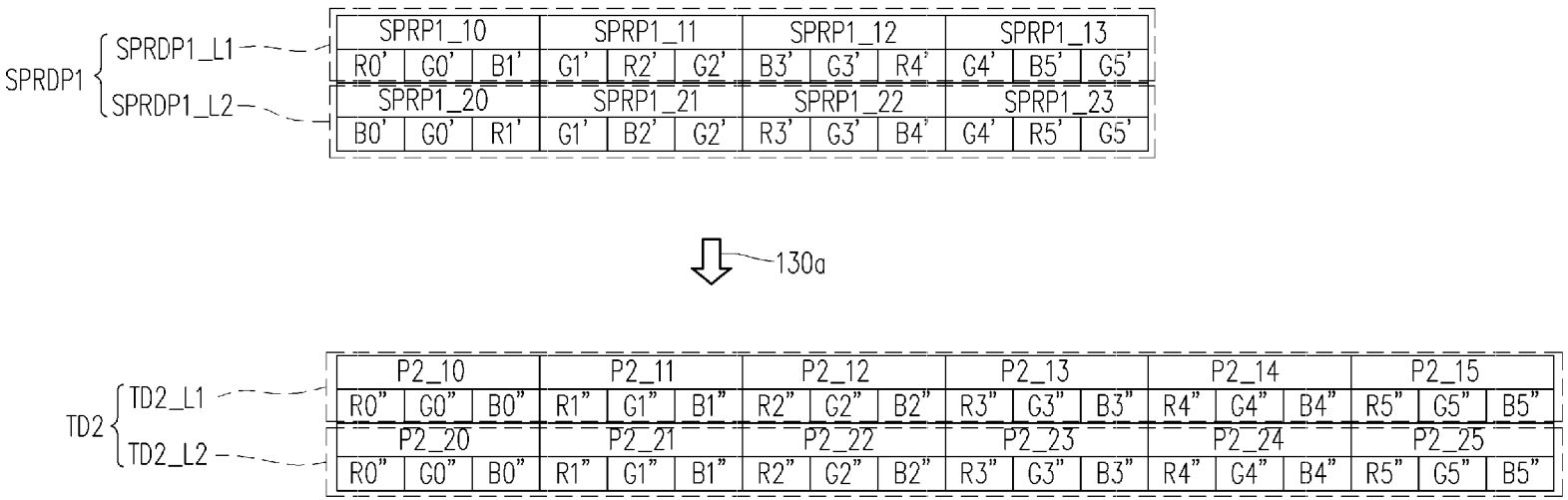
FIG. 8 is a schematic diagram illustrating the inverting operation in FIG. 6.

FIG. 8 is a schematic diagram illustrating the inverting operation in FIG. 6. By the inverting operation, the sub-pixel data of the true image display panel TD2 is calculated based on the sub-pixel rendering data of the SPR display panel SPRDP1. To be more specific, the sub-pixel data of the line TD2_L1 of the true image display panel TD2 is calculated as follows: R0''=2R0', G0''=G0', B0''=B1', R1''=R2', G1''=G1', B1''=B1', R2''=R2', G2''=G2', B2''=B3', R3''=R4', G3''=G3', B3''=B3', R4''=R4', G4''=G4', B4''=B5', R5''=R6', G5''=G5', B5''=B5'. Additionally, the sub-pixel data of the line TD2_L2 of the true image display panel TD2 is calculated as follows: R0''=R1', G0''=G0', B0''=2B0', R1''=R1', G1''=G1', B1''=B2', R2''=R3', G2''=G2', B2''=B2', R3''=R3', G3''=G3', B3''=B4', R4''=R5', G4''=G4', B4''=B4', R5''=R5', G5''=G5', and B5''=B6'. The first sub-pixel rendering operation and the inverting operation are described in FIG. 7 and FIG. 8 as an example, the disclosure is not limited thereto.

It should be noted here, in the embodiment shown in FIGS. 6-8, the sub-pixel rendering arrangement SPRA of the SPR display panel SPRDP1 is converted to the sub-pixel rendering arrangement SPRB of the SPR display panel SPRDP2.

Figure 9:
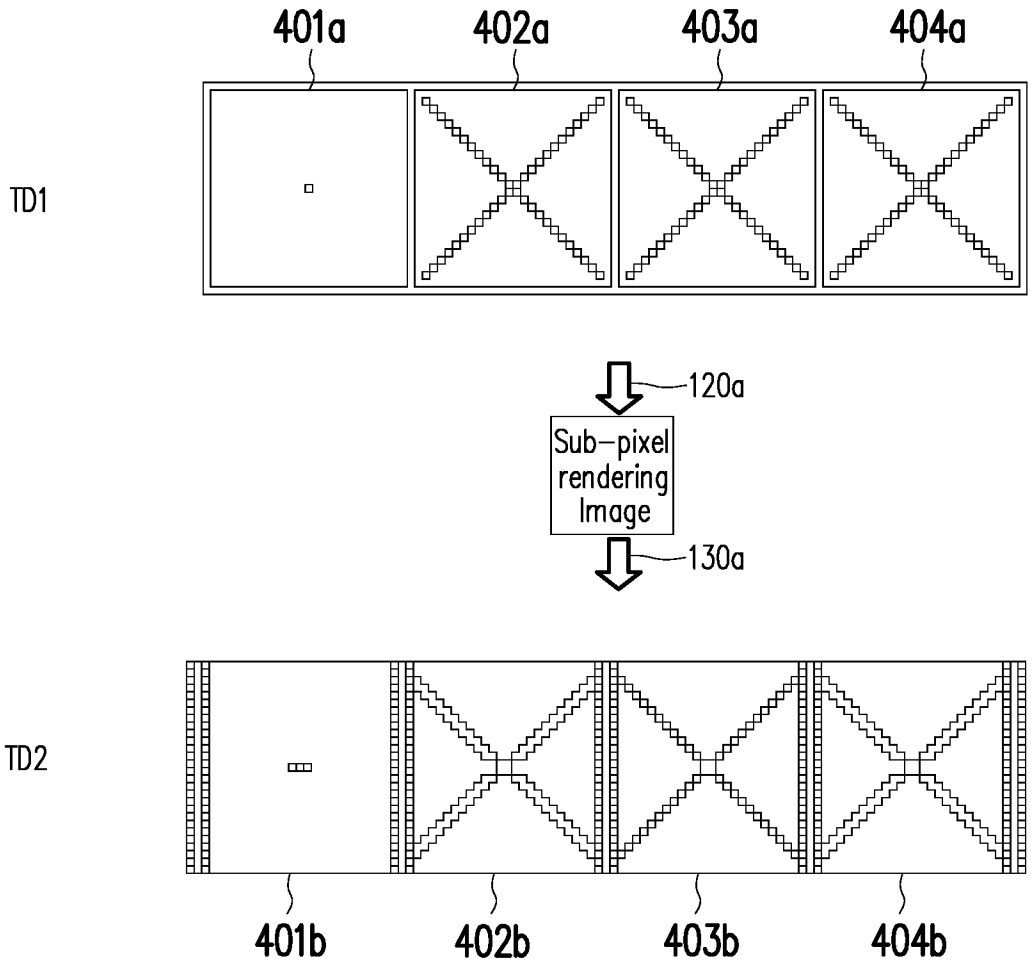
FIG. 9 is a schematic diagram illustrating an image displayed before the first sub-pixel rendering operation and after the inverting operation in FIG. 6.

FIG. 9 is a schematic diagram illustrating an image displayed before the first sub-pixel rendering operation and after the inverting operation in FIG. 6 according to one embodiment of the disclosure. As shown in FIG. 9, the true image display panel TD1 includes four display areas 401*a*, 402*a*, 403*a*, 404*a*. The display area 401*a* displays a white dot, the display area 402*a* displays red color forming an X-shape, the display area 403*a* displays green color forming an X-shape, and the display area 404*a* displays blue color forming an X-shape. After the first sub-pixel rendering operation 120*a*, the true image of the true image display panel TD1 is converted to a sub-pixel rendering image. After the inverting operation 130*a*, the sub-pixel rendering image is inverted to a true image displayed in the true image display panel TD2. The true image display panel TD2 includes four display areas 401*b*, 402*b*, 403*b*, and 404*b* respectively corresponding to the four display areas 401*a*, 402*a*, 403*a*, and 404*a* of the true image display panel TD1. As shown in FIG. 9, after the inverting operation 130*a*, the true image display panel TD2 can still display similar figures to the true image display panel TD1.

Figure 10:
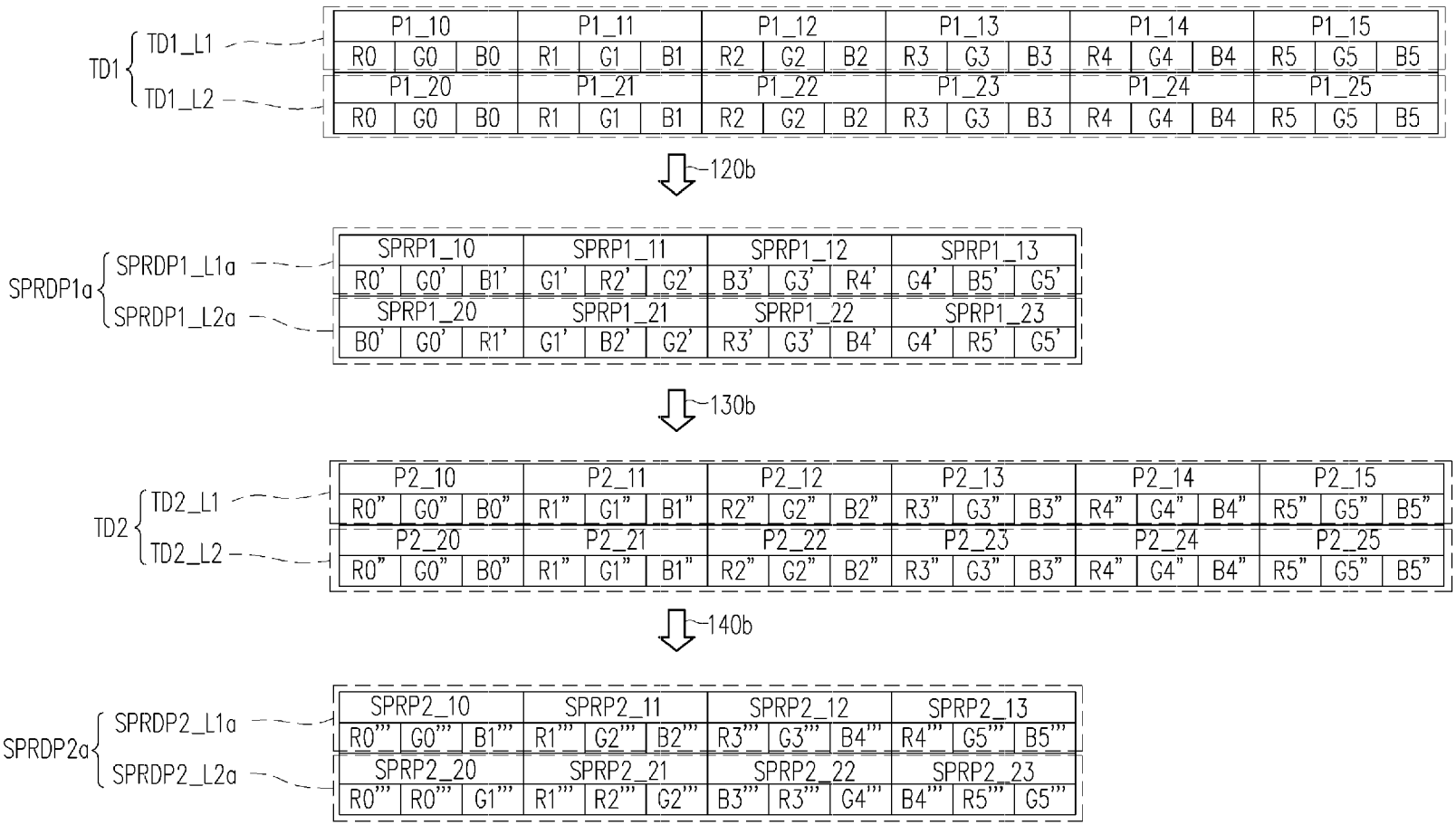
FIG. 10 is a schematic diagram illustrating data conversion process according to another embodiment of the disclosure.

FIG. 10 is a schematic diagram illustrating data conversion process according to another embodiment of the disclosure. The present embodiment is similar to the embodiment shown in FIG. 6, only the differences are described hereinafter. In the present embodiment, a SPR display panel SPRDP1 has the sub-pixel rendering arrangement SPRA, and a SPR display panel SPRDP2*a* has the sub-pixel rendering arrangement SPRB. Therefore, in the present embodiment, the sub-pixel rendering arrangement SPRB of the SPR display panel SPRDP1 is converted to the sub-pixel rendering arrangement SPRA of the SPR display panel SPRDP2.

Figure 11:
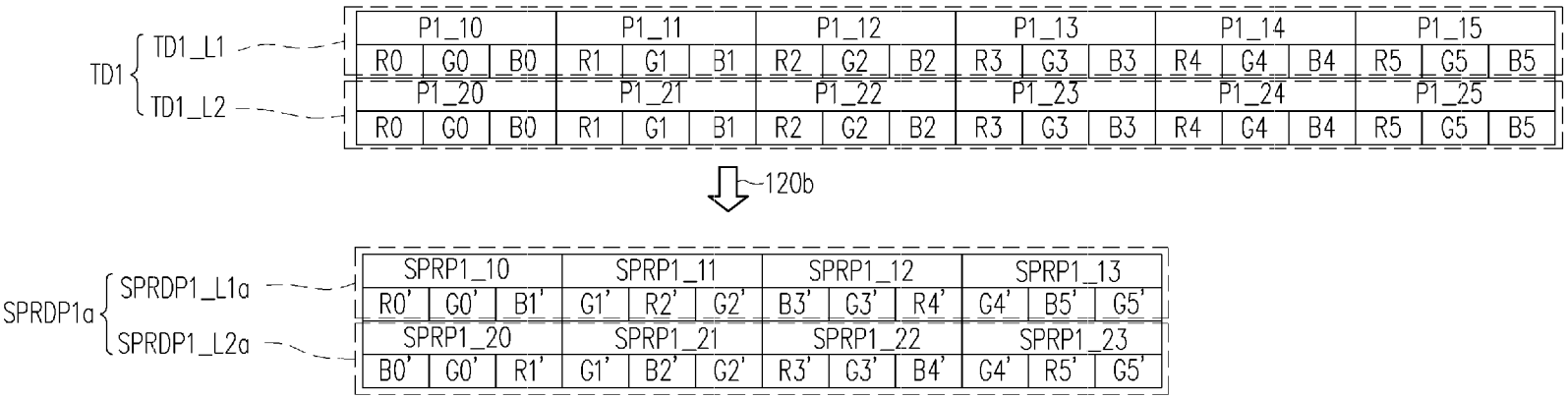
FIG. 11 is a schematic diagram illustrating the first sub-pixel rendering operation in FIG. 10.

FIG. 11 is a schematic diagram illustrating the first sub-pixel rendering operation in FIG. 10. In the first sub-pixel rendering operation, the sub-pixel rendering data of a line SPRDP1_L1*a* is calculated as follows: R0'=(0+2R0)/3, R1'=(2R1+R2)/3, R3'=(R2+2R3)/3, R4'=(2R4+R5)/3, G0'=(2G0+G1)/3, G2'=(G1+2G2)/3, G3'=(2G3+G4)/3, G5'=(G4+2G5)/3, B1'=(B0+2B1)/3, B2'=(2B2+B3)/3, B4'=(B3+2B4)/3, and B5'=(2B5+B6)/3. Additionally, the sub-pixel rendering data of a line SPRDP1_L2*a* is calculated as follows: R0'=(2R0+R1)/3, R2'=(R1+2R2)/3, R3'=(2R3+R4)/3, R5'=(R4+2R5)/3, G1'=(G0+2G1)/3, G2'=(2G2+G3)/3, G4'=(G3+2G4)/3, G5'=(2G5+G6)/3, B0'=(0+2B0)/3, B1'=(2B1+B2)/3, B3'=(B2+2B3)/3, and B4'=(2B4+B5)/3.

Figure 12:
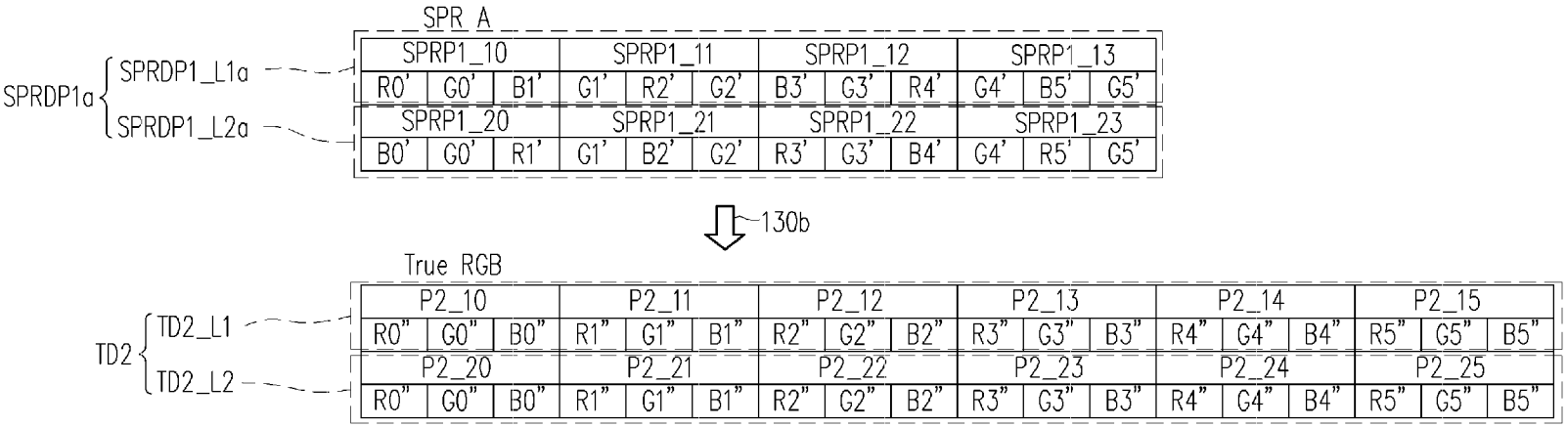
FIG. 12 is a schematic diagram illustrating the inverting operation in FIG. 10.

FIG. 12 is a schematic diagram illustrating the inverting operation in FIG. 10. In the inverting operation, the sub-pixel data of the true image display panel TD2 is calculated based on the sub-pixel rendering data of the SPR display panel SPRDP1*a*. To be more specific, the sub-pixel data of the line TD2_L1 of the true image display panel TD2 is calculated as follows: R0''=3R0'/2, G0''=G0', B0''=B1', R1''=R1', G1''=(G0'+G2')/2, B1''=B1', R2''=(R1'+R3')/2, G2''=G2', B2''=B2', R3''=R3', G3''=G3', B3''=(B2'+B4')/2, R4''=R4', G4''=(G3'+G5')/2, B4''=B4', G5''=G5', and B5''=B5'. Additionally, the sub-pixel data of the line TD2_L2 of the true image display panel TD2 is calculated as follows: R0''=R0', G0''=G1', B0''=3B0'/2, R1''=(R0'+R2)/

2, G1"=G1', B1"=B1', R2"=R2', G2"=G2', B2"=(B1'+B3')/2, R3"=R3', G3"=(G2'+G4')/2, B3"=B3', R4"=(R3+R5')/2, G4"=G4', B4"=B4', R5"=R5', G5"=G5', and B5"=(B4'+B5')/2.

Figure 13:
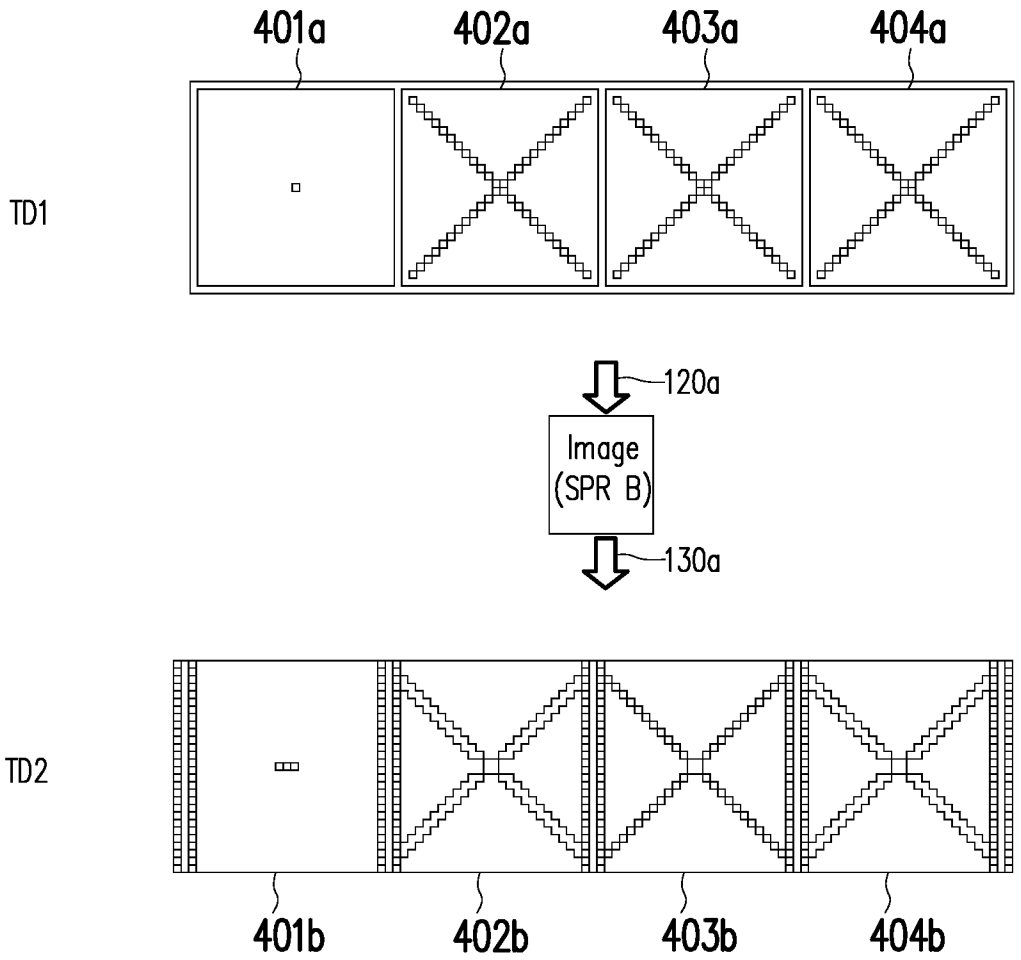
FIG. 13 is a schematic diagram illustrating an image displayed before the first sub-pixel rendering operation and after the inverting operation in FIG. 10.

FIG. 13 is a schematic diagram illustrating an image displayed before the first sub-pixel rendering operation and after the inverting operation in FIG. 10. Similar to FIG. 9, the true image display panel TD1 includes four display areas 401*a*, 402*a*, 403*a*, 404*a*. The display area 401*a* displays a white dot, the display area 402*a* displays red color forming an X-shape, the display area 403*a* displays green color forming an X-shape, and the display area 404*a* displays blue color forming an X-shape. After the first sub-pixel rendering operation, the true image of the true image display panel TD1 is converted to a sub-pixel rendering image. After the inverting operation, the sub-pixel rendering image is inverted to a true image displayed in the true image display panel TD2. The true image display panel TD2 includes four display areas 401*b*, 402*b*, 403*b*, and 404*b* respectively corresponding to the four display areas 401*a*, 402*a*, 403*a*, and 404*a* of the true image display panel TD1. As shown in FIG. 13, after the inverting operation, the true image display panel TD2 can still display similar figures to the true image display panel TD1.

Figure 14:
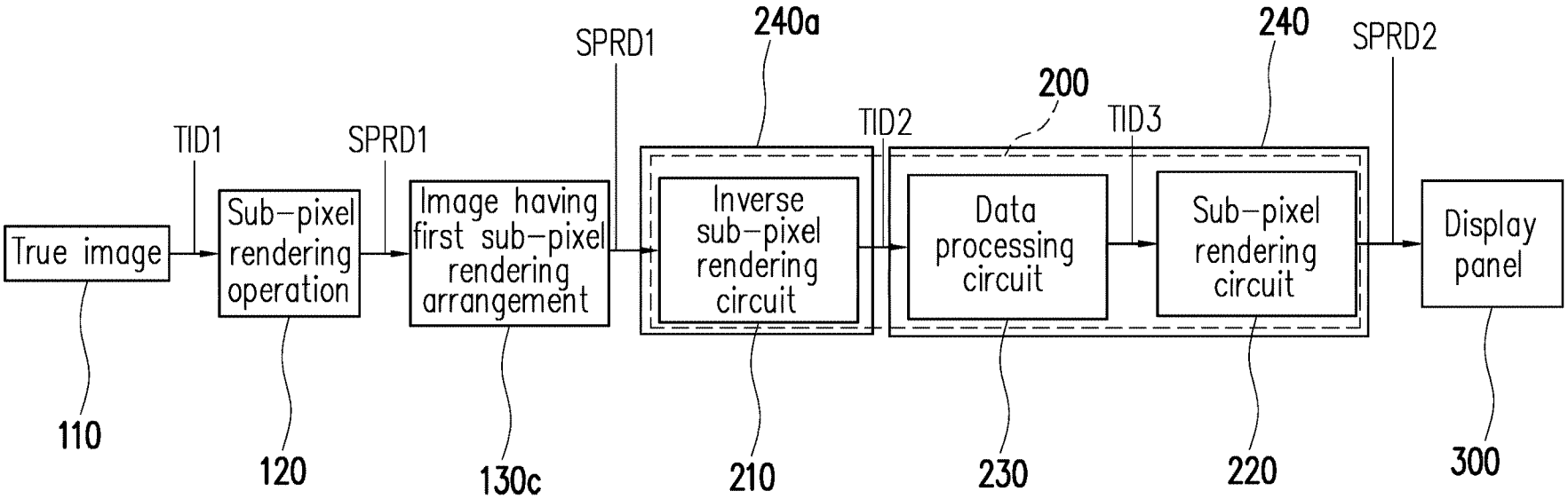
FIG. 14 is a schematic view illustrating data conversion process according to another embodiment of the disclosure.

FIG. 14 is a schematic view illustrating data conversion process according to another embodiment of the disclosure. The data conversion process in the present embodiment is similar to the data conversion process of the embodiment in FIG. 1, only the differences are described hereinafter. In the present embodiment, the sub-pixel rendering circuit 220 is located in the driver chip 240, but the inverse sub-pixel rendering circuit 210 is located in a decoder chip 240*a*.

Figure 15:
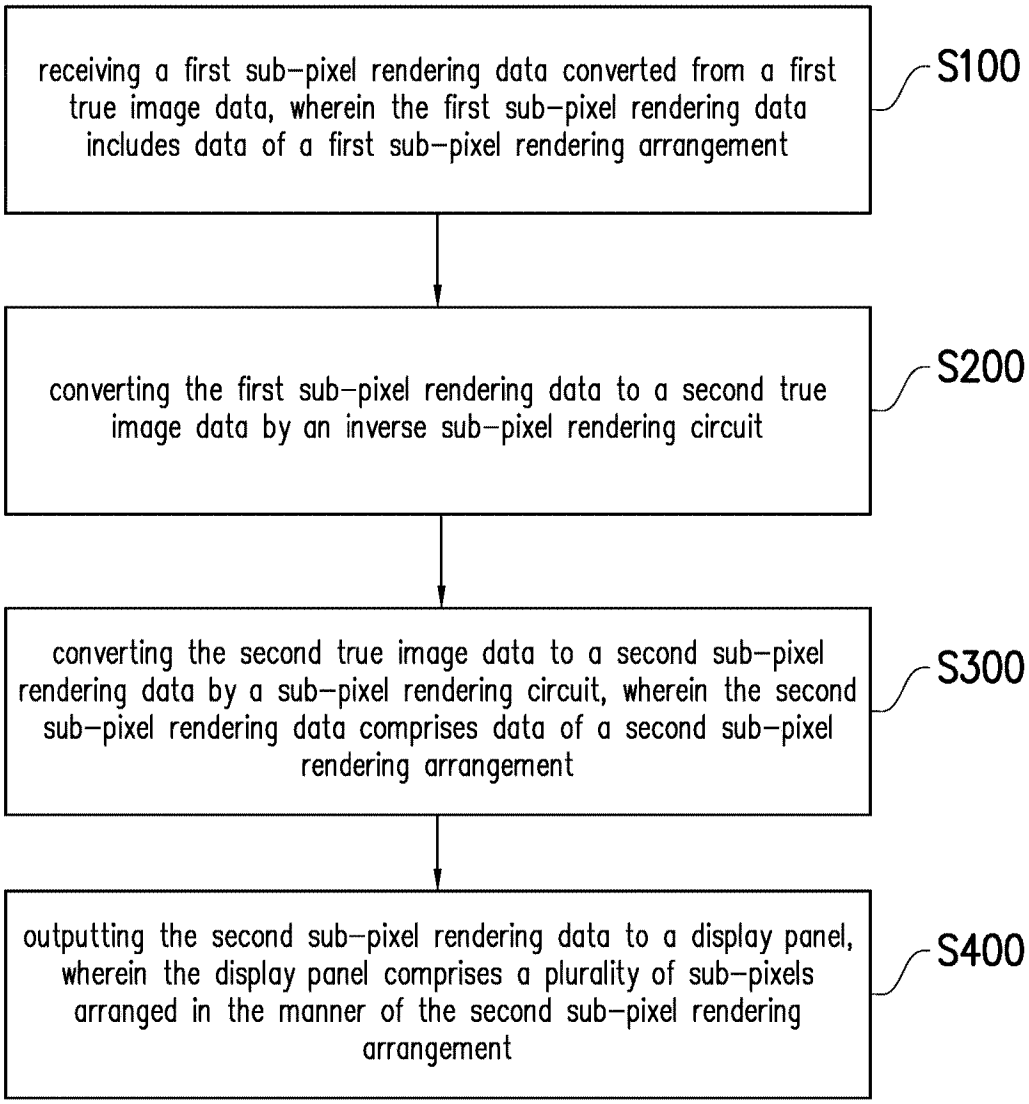
FIG. 15 is a flow chart illustrating a sub-pixel rendering data conversion method according to one embodiment of the disclosure.

FIG. 15 is a flow chart illustrating a sub-pixel rendering data conversion method according to one embodiment of the disclosure. Referring to FIG. 15 and FIG. 1 at the same time, in the Step S100, the inverse sub-pixel rendering circuit 210 receives the first sub-pixel rendering data SPRD1 converted from the first true image data TID1, and the first sub-pixel rendering data SPRD1 includes data of the first sub-pixel rendering arrangement (one of the sub-pixel rendering arrangements SPRA and SPRB). In step S200, the first sub-pixel rendering data SPRD1 is converted to the second true image data TID2 by the inverse sub-pixel rendering circuit 210. Next, in Step S300, the sub-pixel rendering circuit 220 converts the second true image data TID2 (or the third true image data TID3 converted from the second true image data TID2) to the second sub-pixel rendering data SPRD2, the second sub-pixel rendering data SPRD2 includes data of the second sub-pixel rendering arrangement (the other one of the sub-pixel rendering arrangements SPRA and SPRB). Finally, in Step S400, the sub-pixel rendering circuit 220 outputs the second sub-pixel rendering data SPRD2 to the display panel 300, and the display panel 300 includes a plurality of sub-pixels arranged in the manner of the second sub-pixel rendering arrangement.

Figure 16:
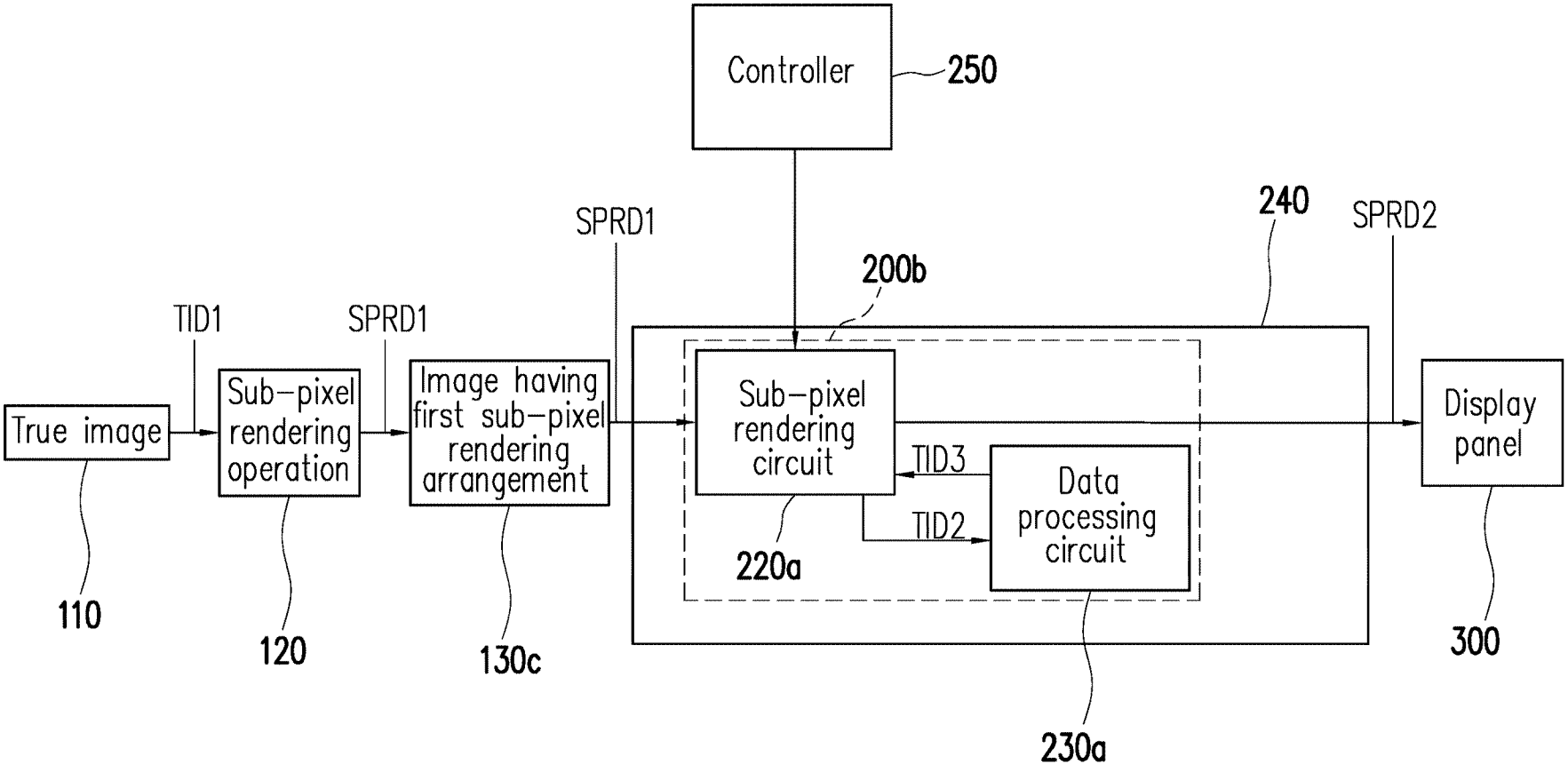
FIG. 16 is a schematic view illustrating data conversion process according to another embodiment of the disclosure.

FIG. 16 is a schematic view illustrating data conversion process according to another embodiment of the disclosure. The data conversion process in FIG. 16 is similar to the data conversion process in FIG. 1, only the differences are described hereinafter. In FIG. 16, a sub-pixel rendering data conversion apparatus 200*b* includes a sub-pixel rendering circuit 220*a*. The sub-pixel rendering circuit 220*a* is configured to receive the first sub-pixel rendering data SPRD1 converted from the first true image data TID1 and convert the first sub-pixel rendering data SPRD1 to the second true image data TID2 at the first time, wherein the first sub-pixel rendering data SPRD1 includes data of the first sub-pixel rendering arrangement (such as one of the sub-pixel rendering arrangement SPRA and the sub-pixel rendering arrangement SPRB in FIG. 2). In the present embodiment, the sub-pixel rendering data conversion apparatus 200*b* includes a data processing unit 230*a* located in the driver chip 240, and the second true image data TID2 is further processed by the data processing unit 230*a*. In other words, the second true image data TID2 is provided to the data processing unit 230*a* so as to be converted to the third true image data TID3 by the data processing unit 230*a*. The second true image data TID2 and the third true image data TID3 may be the same or different from each other, the invention is not limited thereto. The third true image data TID3 is then provided to the sub-pixel rendering circuit 220*a* by the data processing unit 230*a*.

Next, the sub-pixel rendering circuit 220*a* is configured to convert the third true image data TID3 to the second sub-pixel rendering data SPRD2 and output the second sub-pixel rendering data SPRD2 to the display panel 300 at a second time. The second sub-pixel rendering data SPRD2 includes data of the second sub-pixel rendering arrangement (such as the other one of the sub-pixel rendering arrangement SPRA and the sub-pixel rendering arrangement SPRB in FIG. 2), and the display panel 300 includes a plurality of sub-pixels arranged in the manner of the second sub-pixel rendering arrangement.

To be more specific, a controller 250 controls the sub-pixel rendering circuit 220*a* to perform an inverse function at the first time and a forward function at the second time. The inverse function is performed to convert the first sub-pixel rendering data SPRD1 to the second true image data TID2, and the forward function is performed to convert the second true image data TID2 to the second sub-pixel rendering data SPRD2.

Further, in the present embodiment, the sub-pixel rendering circuit 220*a* is located in the driver chip 240. However, the disclosure is not limited thereto, the sub-pixel rendering circuit may be located in a decoder chip in other embodiments.

In summary, the first sub-pixel rendering data including data of the first sub-pixel rendering arrangement is received and then is inverted to the true image data that is converted to the second sub-pixel rendering data including data of the second sub-pixel rendering arrangement. The first sub-pixel rendering arrangement and the second sub-pixel rendering arrangement are different. Therefore, the data of different sub-pixel rendering arrangements can be obtained and provided to display panels.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A sub-pixel rendering data conversion apparatus, comprising:

an inverse sub-pixel rendering circuit, receiving a first sub-pixel rendering data converted from a first true image data and converting the first sub-pixel rendering data to a second true image data, wherein the first sub-pixel rendering data comprises data of a first sub-pixel rendering arrangement; and a sub-pixel rendering circuit, converting the second true image data to a second sub-pixel rendering data and outputting the second sub-pixel rendering data to a display panel, wherein the second sub-pixel rendering data comprises data of a second sub-pixel rendering arrangement, and the display panel comprises a plurality of sub-pixels arranged in the manner of the second sub-pixel rendering arrangement.

2. The sub-pixel rendering data conversion apparatus as recited in claim 1, wherein the inverse sub-pixel rendering circuit and the sub-pixel rendering circuit are located in a driver chip.

3. The sub-pixel rendering data conversion apparatus as recited in claim 2, further comprising a data processing circuit located in the driver chip, wherein the second true image data is further processed by the data processing circuit.

4. The sub-pixel rendering data conversion apparatus as recited in claim 1, wherein the sub-pixel rendering circuit is located in a driver chip, and the inverse sub-pixel rendering circuit is located in a decoder chip.

5. The sub-pixel rendering data conversion apparatus as recited in claim 4, further comprising a data processing circuit located in the driver chip, wherein the second true image data is further processed by the data processing circuit.

6. The sub-pixel rendering data conversion apparatus as recited in claim 1, wherein the first sub-pixel rendering arrangement and the second sub-pixel rendering arrangement are different.

7. A sub-pixel rendering data conversion method, comprising:

receiving a first sub-pixel rendering data converted from a first true image data, wherein the first sub-pixel rendering data comprises data of a first sub-pixel rendering arrangement;

converting the first sub-pixel rendering data to a second true image data by an inverse sub-pixel rendering circuit;

converting the second true image data to a second sub-pixel rendering data by a sub-pixel rendering circuit, wherein the second sub-pixel rendering data comprises data of a second sub-pixel rendering arrangement; and outputting the second sub-pixel rendering data to a display panel, wherein the display panel comprises a plurality of sub-pixels arranged in the manner of the second sub-pixel rendering arrangement.

8. The sub-pixel rendering data conversion method as recited in claim 7, wherein the inverse sub-pixel rendering circuit and the sub-pixel rendering circuit are located in a driver chip.

9. The sub-pixel rendering data conversion method as recited in claim 8, further comprising:

processing the second true image data by a data processing circuit located in the driver chip.

10. The sub-pixel rendering data conversion method as recited in claim 7, wherein the sub-pixel rendering circuit is located in a driver chip, and the inverse sub-pixel rendering circuit is located in a decoder chip.

11. The sub-pixel rendering data conversion method as recited in claim 10, further comprising:

processing the second true image data by a data processing circuit located in the driver chip.

12. The sub-pixel rendering data conversion method as recited in claim 7, wherein the first sub-pixel rendering arrangement and the second sub-pixel rendering arrangement are different.

13. A sub-pixel rendering data conversion apparatus, comprising:

a sub-pixel rendering circuit, configured to receive a first sub-pixel rendering data converted from a first true image data and convert the first sub-pixel rendering data to a second true image data at a first time, wherein the first sub-pixel rendering data comprises data of a first sub-pixel rendering arrangement, and the sub-pixel rendering circuit is configured to convert the second true image data to a second sub-pixel rendering data and output the second sub-pixel rendering data to a display panel at a second time, wherein the second sub-pixel rendering data comprises data of a second sub-pixel rendering arrangement, and the display panel comprises a plurality of sub-pixels arranged in the manner of the second sub-pixel rendering arrangement.

14. The sub-pixel rendering data conversion apparatus as recited in claim 13, wherein a controller controls the sub-pixel rendering circuit to perform an inverse function at the first time and a forward function at the second time.

15. The sub-pixel rendering data conversion apparatus as recited in claim 13, wherein the sub-pixel rendering circuit is located in a driver chip.

16. The sub-pixel rendering data conversion apparatus as recited in claim 13, wherein the sub-pixel rendering circuit is located in a decoder chip.

17. The sub-pixel rendering data conversion apparatus as recited in claim 15, further comprising a data processing unit located in the driver chip, wherein the second true image data is further processed by the data processing unit.

* * * * *